US005316086A

United States Patent [19]

DeMoss

[11] Patent Number: 5,316,086

[45] Date of Patent: May 31, 1994

[54] COMBINATION WELL CASING PRESSURE RELIEF AND KILL VALVE APPARATUS

[75] Inventor: Edward E. DeMoss, Garland, Tex.

[73] Assignee: Halliburton Company, Duncan, Okla.

[21] Appl. No.: 990,639

[22] Filed: Dec. 14, 1992

[51] Int. Cl.[5] ..... E21B 34/06

[52] U.S. Cl. ..... 166/373; 166/319

[58] Field of Search ..... 166/319, 320, 321, 322, 166/324, 373, 371, 387

[56] References Cited

U.S. PATENT DOCUMENTS

| | | | |
|---|---|---|---|
| 3,310,114 | 3/1967 | Dollison | 166/322 |
| 3,456,728 | 7/1969 | Chenoweth | 166/320 |
| 3,474,859 | 10/1969 | Chenoweth | 166/320 |
| 3,601,191 | 8/1971 | McMurry et al. | 166/319 |
| 3,847,223 | 11/1974 | Scott et al. | 166/322 |
| 4,046,335 | 9/1983 | Koot | 166/319 |
| 4,119,146 | 10/1978 | Taylor | 166/321 |
| 4,284,141 | 8/1981 | Mott | 166/322 |
| 4,399,871 | 8/1983 | Adkins et al. | 166/325 |
| 4,420,043 | 12/1983 | Brooks | 166/319 |
| 4,586,567 | 5/1986 | Jameson | 166/322 |

*Primary Examiner*—Ramon S. Britts
*Assistant Examiner*—Frank S. Tsay
*Attorney, Agent, or Firm*—Konneker, Bush & Hitt

[57] ABSTRACT

In a subterranean well having a production tubing string outwardly circumscribed by a brine-filled casing annulus, a specially designed combination casing pressure relief and kill valve is supported within a side pocket mandrel installed in the production tubing, the valve having inlet ports communicated with the casing annulus. During an initial production phase of the well, when the casing annulus/production tubing pressure differential reaches a first pressure differential set point of the valve due to a brine temperature increase, a pressure relief portion of the valve opens to admit a relatively low flow rate of annulus brine to the tubing string, thereby relieving the annulus pressure, and then closes to reseal the annulus. When it later becomes necessary to temporarily kill the well, kill fluid is pumped into the casing annulus. As the annulus pressure increases, the first valve set point is reached and the pressure relief portion of the valve opens. However, the flow rate of annulus fluid discharged from the valve into the production tubing is considerably less than the flow rate of kill fluid being pumped into the casing annulus. Accordingly, the fluid pressure differential between the casing annulus and the production tubing rises to a second, higher pressure differential set point of the valve. When this occurs, a kill portion of the valve permanently opens to admit kill fluid into the production tubing at a considerably higher flow rate than the pressure relief outflow rate of the valve.

22 Claims, 2 Drawing Sheets

COMBINATION WELL CASING PRESSURE RELIEF AND KILL VALVE APPARATUS

BACKGROUND OF THE INVENTION

The present invention generally relates to downhole valve apparatus used in subterranean well completions and, in a preferred embodiment thereof, more particularly relates to a specially designed combination well casing pressure relief and kill valve.

In an initially completed subterranean well the bore hole is typically lined with a tubular cemented casing having perforations formed therein at a subsurface production zone to admit pressurized production fluid, such as oil and/or natural gas, into the interior of the casing. To flow the admitted production fluid upwardly to the surface of the well, a production tubing string, having an outer diameter smaller than the inner diameter of the casing, is coaxially inserted downwardly into the casing and connected at its lower end to a packer structure positioned above the casing perforations.

The packer seals off the interior portion of the casing below the packer from the annular space between the casing and production tubing above the packer, while at the same time communicating the interior of the production tubing with the casing interior below the packer. To provide hydraulic support for the casing, the casing annulus above the packer in the initially completed well is typically filled with a brine solution. When production flow from the completed well is started, the pressurized production fluid enters the casing through its perforations and flows upwardly through the packer and the production tubing string to the surface of the well for retrieval.

As this initial production continues, the relatively elevated temperature of the upwardly flowing production fluid transfers heat, via the production tubing string, to the sealed-in brine solution within the casing annulus. This production fluid heat transferred to the brine correspondingly increases its pressure, thereby materially increasing the laterally outwardly directed hydraulic force exerted by the brine on the casing. In order to prevent this increased pressure from damaging the casing, it is necessary to relieve the temperature-elevated brine pressure.

A conventional method of automatically providing for this brine pressure relief as the need arises is to install in a subsurface portion of the production tubing string a receptacle, commonly referred to as a side pocket mandrel, that operatively and removably receives a pressure relief valve. The mandrel-received pressure relief valve has an inlet that communicates with the casing annulus via side wall inlet ports in the mandrel, and an outlet communicated with the interior of the mandrel and thus with the interior of the production tubing string. When the casing annulus pressure increases to a level above the set point pressure of the valve, the valve opens to admit pressurized brine from the casing annulus into the production tubing string until the casing annulus pressure falls below the valve set point pressure, whereupon the valve closes to reseal the now lower pressure brine within the casing annulus. This pressure relief valve can also be used in a chemical injection application in which a selected chemical solution is pumped into the casing annulus for introduction into the tubing string via the valve.

Later in the production life of the well it typically becomes necessary to stimulate or otherwise work over the well due to a reduction in its production fluid flow rate caused, for example, by an obstruction of its casing perforations. In order to perform this repair work it is necessary to temporarily "kill" the well—i.e., to temporarily terminate the inflow of production fluid into the casing beneath the packer. The eventual necessity of performing this kill function is typically prepared for in advance by initially installing in the production tubing string a second side pocket mandrel that operatively and removably receives a kill valve. The kill valve has an inlet that communicates with the casing annulus via side inlet ports in its associated mandrel, and an outlet communicated with such mandrel and thus with the interior of the production tubing string.

When it becomes necessary to temporarily kill the well, a kill fluid (such as brine or drilling mud) is pumped into the casing annulus. The continuous pressurized inflow of kill fluid into the casing annulus elevates the annulus pressure until the kill valve pressure set point is reached, at which point the kill valve opens to admit a sustained flow of kill fluid into the production tubing string. The entering kill fluid travels upwardly through the production tubing string and eventually forms a standing kill fluid column which hydraulically prevents upward flow of production fluid through the tubing string.

To provide in advance for these necessary pressure relief and kill functions in an initially completed subterranean well, as described above, it has heretofore been necessary to install in the production tubing string two separate mandrels and a separate valve within each mandrel. This installation redundancy, of course, appreciably increases the overall fabrication cost of the completed well—particularly where the well is constructed offshore. It is accordingly an object of the present invention to provide, in a well completion, these pressure relief and kill functions in a more cost effective manner.

SUMMARY OF THE INVENTION

In carrying out principles of the present invention, in accordance with a preferred embodiment thereof, a specially designed combination casing pressure relief and kill valve is provided for incorporation in a subterranean well system having a bore hole extending downwardly into the earth, a tubing string extending downwardly through the bore hole and operative to flow a subsurface production fluid upwardly to the surface, a casing structure lining the bore hole, and a sealed, fluid-filled annulus circumscribing the tubing string and radially outwardly bounded by the casing structure.

The valve is operatively installed within a conventional downhole valve receptacle connected in the tubing string and having an interior communicating with the interior of the tubing string, and an inlet opening communicating with the casing annulus. In a preferred embodiment thereof the installed valve includes a hollow body having an inlet opening communicating with the casing annulus through the receptacle inlet opening, first and second outlet openings communicating with the interior of the receptacle, and thus with the interior of the tubing string, and seal means carried externally on the valve body and sealingly isolating the valve body inlet opening from the first and second valve body outlet openings.

The valve body is provided with a first internal flow passage extending between the body inlet opening and the first valve body outlet opening, and a second internal flow passage extending between the body inlet opening and the second outlet opening in parallel with the first internal flow passage.

First normally closed flow control means are interposed in the first internal valve body flow passage and are openable, to permit casing annulus fluid outflow through the first internal flow passage and the first valve body outlet opening into the valve receptacle, and thus into the tubing string, in response to a rise in the casing annulus/tubing string fluid pressure differential to a first set point magnitude. The first flow control means subsequently reclose, thereby again precluding casing fluid outflow into the valve receptacle through the first internal flow passage and the first valve body outlet opening, in response to a fall in the magnitude of the casing annulus/tubing string fluid pressure differential to below the first set point magnitude thereof.

Second normally closed flow control means are interposed in the second valve body internal flow passage and are openable, to permit casing fluid outflow through the second internal flow passage and the second valve body outlet opening into the valve receptacle, in response to a rise in the casing annulus/tubing string fluid pressure differential to a second set point magnitude substantially greater than the first set point magnitude thereof.

During an initial production period of the well, heat from subsurface production fluid upwardly traversing the tubing string is transferred to the casing annulus fluid, correspondingly increasing its pressure. When the casing annulus/tubing string fluid pressure differential reaches the first set point magnitude, the first flow control means automatically open to relieve the elevated fluid pressure in the casing annulus. As sufficient elevated pressure annulus fluid is flowed into the tubing string to cause the casing annulus/tubing string fluid pressure differential to fall below the first set point magnitude, the first flow control means automatically close to reseal the casing annulus.

During a subsequent production period of the well, when it becomes necessary to kill the well, a pressurized kill fluid is pumped downwardly into the casing annulus, from the surface of the well, at a flow rate substantially higher than the flow rate capacity of the first valve body internal flow passage. As the inflowing kill fluid raises the casing annulus/tubing string fluid pressure differential to its first set point magnitude, the first flow control means open to permit a relatively small annulus fluid outflow into the valve receptacle via the first internal flow passage and first outlet opening of the valve body as is the case when the valve is performing its annulus pressure relief function.

However, since the now opened first internal flow passage of the valve body cannot discharge annulus fluid as fast as pressurized kill fluid is entering the casing annulus, the casing annulus/tubing string fluid pressure differential continues to rise despite the opening of the first flow control means. When this rising pressure differential reaches the second set point magnitude, the second flow control means automatically open to admit casing annulus fluid into the tubing string at a flow rate equal to the flow rate of kill fluid being pumped into the casing annulus. This permits a rising column of kill fluid to be formed in the tubing string and eventually terminate the upflow therethrough of production fluid, thereby readying the well for stimulation or other repair procedures.

Importantly, the present invention provides a single valve that automatically provides for both a pressure relief of the casing annulus during an initial production period of the completed well, and also automatically functions as a kill valve, during a subsequent production period of the well, to permit a considerably greater flow of annulus fluid into the tubing string in response to the forced inflow of kill fluid into the casing annulus. Thus, these two necessary functions are performed using only a single valve, and one associated valve receptacle, as opposed to the previous necessity of using two separate valves and two associated valve receptacles to provide these well operation functions. The present invention thereby advantageously eliminates the purchase cost, and associated installation expense, of one valve and one valve receptacle in the completed well.

In a preferred embodiment of the combination casing pressure relief and kill valve of the present invention, the valve body has an elongated hollow cylindrical shape, with the valve body inlet opening being centrally disposed along the length of the body. The first internal flow passage extends axially from the inlet opening to the top end of the valve body which is conveniently defined by a generally cylindrical latch member having a relatively small diameter passage extending therethrough which defines an outer end portion of the first valve body internal flow passage and opens outwardly through the first outlet opening disposed on the latch member. The second internal flow passage extends axially from the inlet opening to the bottom end of the valve body and opens outwardly through the second outlet opening formed thereon. The previously mentioned seal means are preferably defined by annular packer structures externally carried on the valve body above and below its inlet opening.

The first flow control means preferably comprise a main spring loaded relief valve structure operatively interposed in the first internal flow passage, and a spring loaded back check valve structure positioned in the first internal flow passage between the main check valve structure and the first valve body outlet opening.

The second flow control means preferably comprise a main valve structure releasably held in a normally closed position within the second internal flow passage by a frangible draw bar, and a spring loaded check valve member disposed in the second internal flow passage between the draw bar valve structure and the second valve body outlet opening.

DETAILED DESCRIPTION

Figure 1:
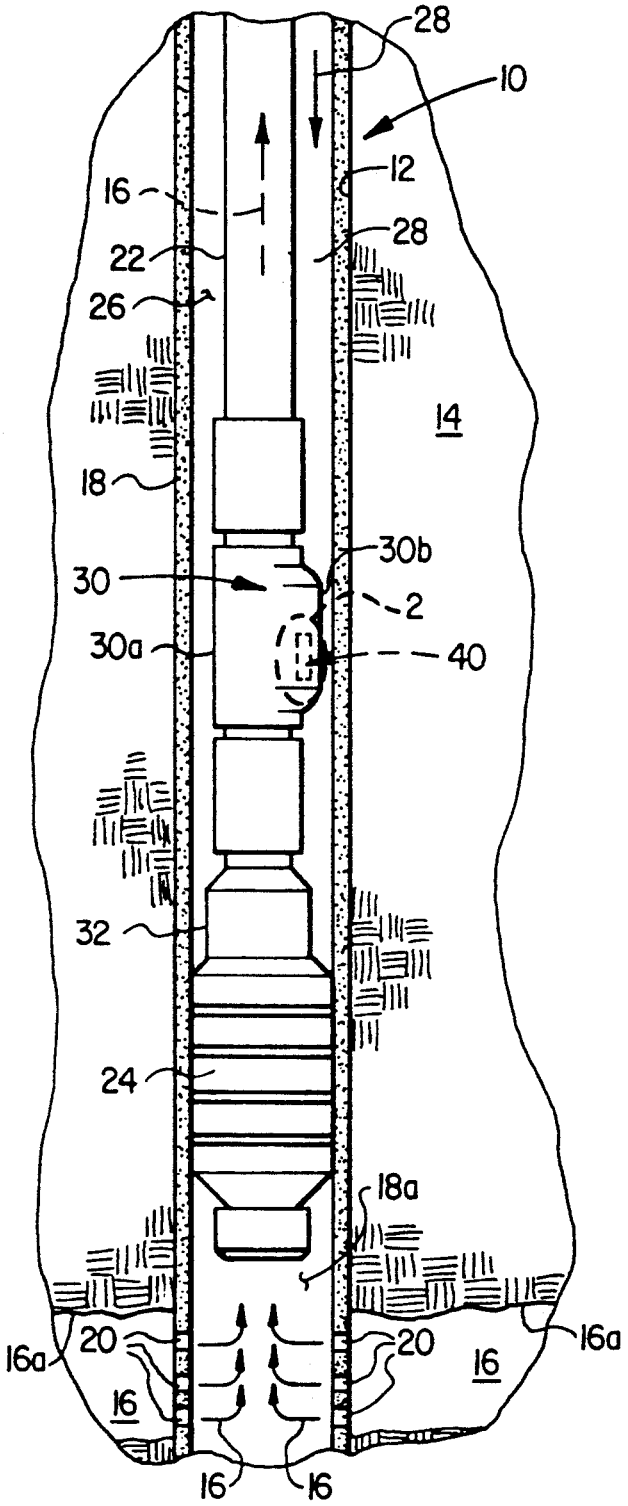
FIG. 1 is a cross-sectional view, partly in elevation, of a lower end portion of a subterranean well completion incorporating therein a combination well casing pressure relief and kill valve embodying principles of the present invention.

Schematically depicted in FIG. 1 is a lower end portion of a representative subterranean well completion 10 that includes a vertical bore hole 12 extending downwardly through the earth 14 and a subsurface zone 16*a* of retrievable production fluid 16 such as oil and/or natural gas. The interior of the bore hole 12 is lined with a cemented tubular casing 18 having a series of inlet perforations 20 extending therethrough at the production zone 16*a*. Extending centrally through the casing 18, above the production zone 16*a*, is a production tubing string 22 connected at its lower end to a generally cylindrical packer structure 24 positioned somewhat above the production zone 16*a*.

The outer diameter of the production tubing string 22 is smaller than the inner diameter of the casing 18. Accordingly, an annulus 26 is defined between the casing 18 and the production tubing string 22 above the packer 24. In order to provide hydraulic support for the casing 18, the casing annulus 26 is filled with a brine solution 28 after the construction of the well is completed.

The packer 24 serves to seal off the interior portion 18*a* of casing 18 beneath the packer from the casing annulus 26 above the packer, while at the same time communicating the interior casing portion 18*a* with the interior of the production tubing string 22. Accordingly, when operation of the well 10 is initiated fluid 16 from the subsurface production zone 16*a* is flowed to the surface of the well sequentially via the casing perforations 20, the interior casing portion 18*a*, the interior of the packer 24, and the interior of the production tubing string 22.

Figure 2:
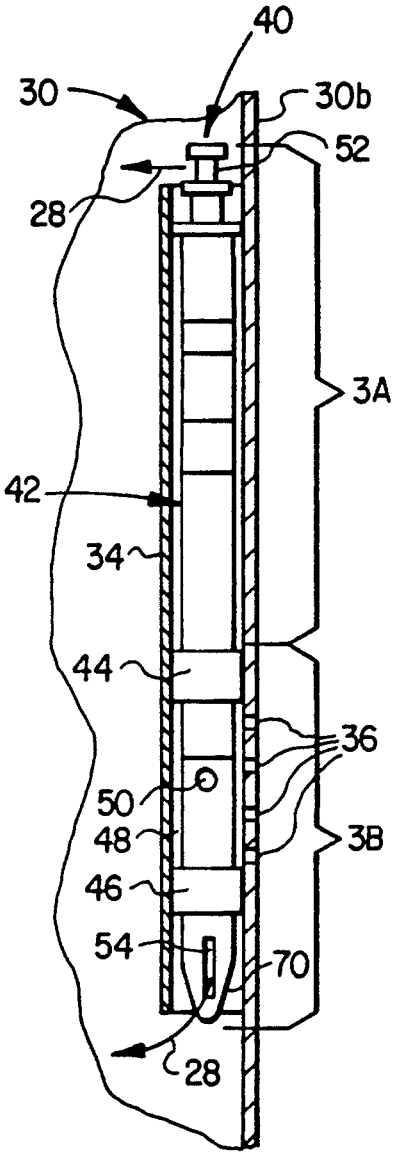
FIG. 2 is a schematic cross-sectional enlargement of the dotted line area "2" in FIG. 1 and illustrates the valve operatively supported in a side pocket mandrel portion of the well completion.

In addition to the conventional well completion components described above, a conventional downhole valve receptacle in the form of a side pocket mandrel 30 is installed in the production tubing string 22 just above a locator and seal assembly 32 positioned atop the packer 24. Mandrel 30 has a tubular body portion 30*a* and a radially outwardly bulging portion 30*b*. As illustrated in FIG. 2, a vertical, open-ended side pocket 34 is welded to the interior side surface of the mandrel portion 30*b* with the interior of the pocket 34 communicated with the casing annulus 26 through a series of inlet ports 36 formed in the vertical side wall of the mandrel portion 30*b*.

According to a key aspect of the present invention, as illustrated in FIGS. 1 and 2, a specially designed combination casing pressure relief and kill valve 40 is operatively and removably supported within the mandrel side pocket 34. Valve 40 has an elongated hollow cylindrical body 42 that is coaxially received in the pocket 34. Vertically spaced annular upper and lower packer structures 44,46 are coaxially carried by the valve body 42 and form annular seals within the pocket 34 above and below the pocket inlet ports 36.

Within the pocket 34 an annular space 48 extending vertically between packers 44,46 circumscribes the valve body 42. Annular space 48 communicates with the casing annulus 26 through the pocket inlet ports 36, and also communicates with the interior of the valve body 42 through a circumferentially spaced series of side wall inlet ports 50 (only one of which is visible in FIG. 2) formed in the valve body between the packers 44,46. A cylindrically cross-sectioned latch member 52 defines a top end portion of the valve body 42, and a circumferentially spaced series of vertically elongated discharge slot 54 (only one of which is visible in FIG. 2) are formed through the bottom end of the valve body 42 and communicate with the interior of the valve body.

After an initial production period of the newly completed well 10, the upflow of production fluid 16 through the tubing string 22 transfers heat to the casing annulus brine solution 28, thereby increasing its pressure. In a manner subsequently described, when the casing annulus/production tubing pressure differential reaches a first pressure differential set point of the valve 40 (representatively 3000 psig) the valve automatically opens to admit elevated pressure casing brine solution 28 to the interior of the valve body 42 sequentially through the mandrel pocket ports 36, the tube annulus 48, and the valve body inlet ports 50.

Pressurized brine solution 28 entering the valve body 42 is discharged therefrom, via the latch member 52 at its top end, into the mandrel portion 30*b*, and thus into the interior of the production tubing string 22, thereby relieving the elevated pressure in the casing annulus 26. When the casing annulus/production tubing pressure differential falls to below the first pressure differential set point of the valve 40 the valve closes to reseal the lowered pressure brine solution 28 within the casing annulus 26.

Much later in the life of the well 10, when the flow rate of the production fluid 16 upwardly traversing the tubing string 26 is reduced due, for example, to an obstruction of the casing perforations 20, it may become necessary to temporarily kill the well to permit a stimulation or other repair procedure to be carried out, or because of some emergency situation it becomes necessary to kill the well to regain control thereof. In accordance with a primary advantage provided by the present invention, the same valve 40 previously used to initially relieve the casing annulus pressure shortly after production initiation also automatically functions as a much larger capacity kill valve.

As subsequently described, when it becomes necessary to kill the well 10 a suitable kill fluid such as additional brine solution 28 (see FIG. 1) is pumped downwardly into the sealed casing annulus 26 from the surface, thereby causing the fluid pressure in the casing annulus to correspondingly increase. When the casing annulus/production tubing pressure differential reaches the first pressure differential set point of the valve 40 the valve first opens to admit brine 28 into the production tubing string 22 as previously described in conjunction with the pressure relief function of the valve.

Figure 3A:
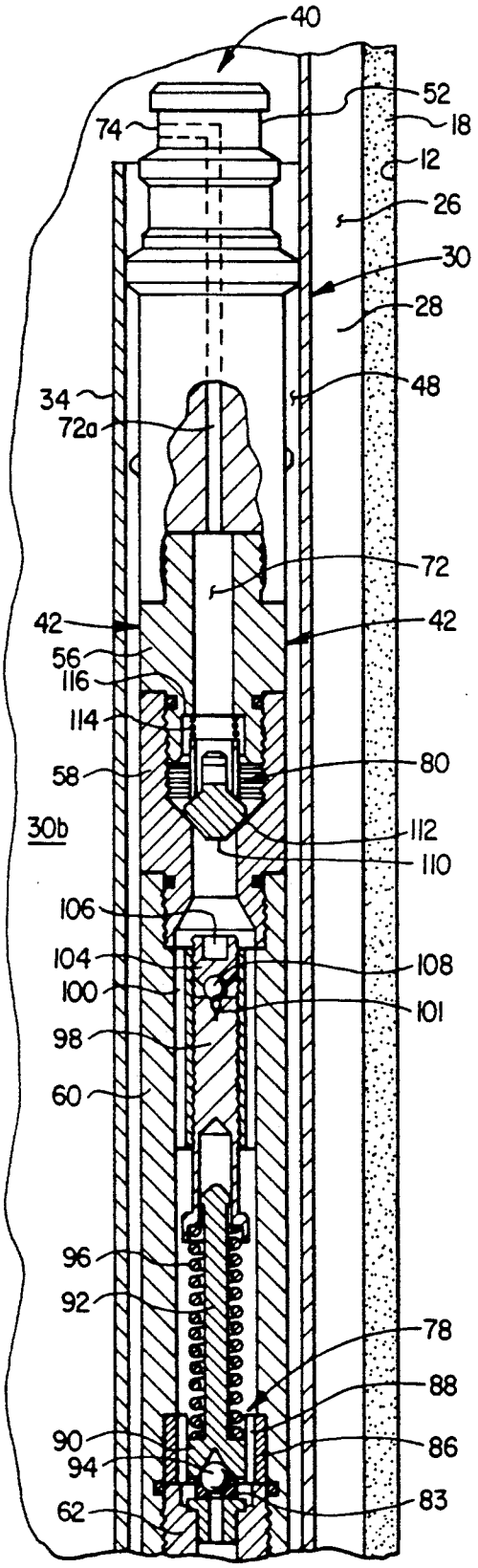
FIGS. 3A and 3B, respectively, are enlarged scale cross-sectional views of the longitudinal portions "3A" and "3B" of the valve shown in FIG. 2.

However, as will be later described herein, the maximum fluid outflow capacity of the latch member 52 and the other valve parts shown in FIG. 3A is relatively small compared to the much larger pressurized inflow rate of the kill fluid 28 being downwardly pumped into the casing annulus 26. Accordingly, the fluid pressure within the casing annulus 2 continues to rise despite this initial pressure relief opening of the dual function valve 40. When the casing annulus/production tubing pressure differential reaches a second pressure differential set point of the valve 40 (representatively about 4000 psig) a second, permanent opening occurs within the valve to permit a much greater flow of kill fluid 28 (see FIG. 2) to be discharged outwardly through the bottom end outlet slots 54 of the valve into the production tubing string 22.

Continued pumping of the kill fluid 28 into the casing annulus 26 creates an increasing height standing column of kill fluid within the production tubing string 22. When such kill fluid column reaches a sufficient height, its weight terminates upward flow of production fluid 16 through the tubing string 22, thereby readying the well for the stimulation or other repair process.

It can be readily seen that in the representative well 10 only one mandrel and one valve provide the well with both automatic pressure relief for the casing annulus during an initial production phase, and subsequent automatic well kill capabilities. Stated in another manner, it is no longer necessary to provide two separate valves, and two separate mandrels to operatively support such valves, to provide the well with these fluid control functions. The overall well fabrication cost is thus advantageously reduced. A detailed description of the structure and operation of the combination pressure relief and well kill valve 40 will now be presented.

Structure and Operation of Valve 40

Figure 3B:
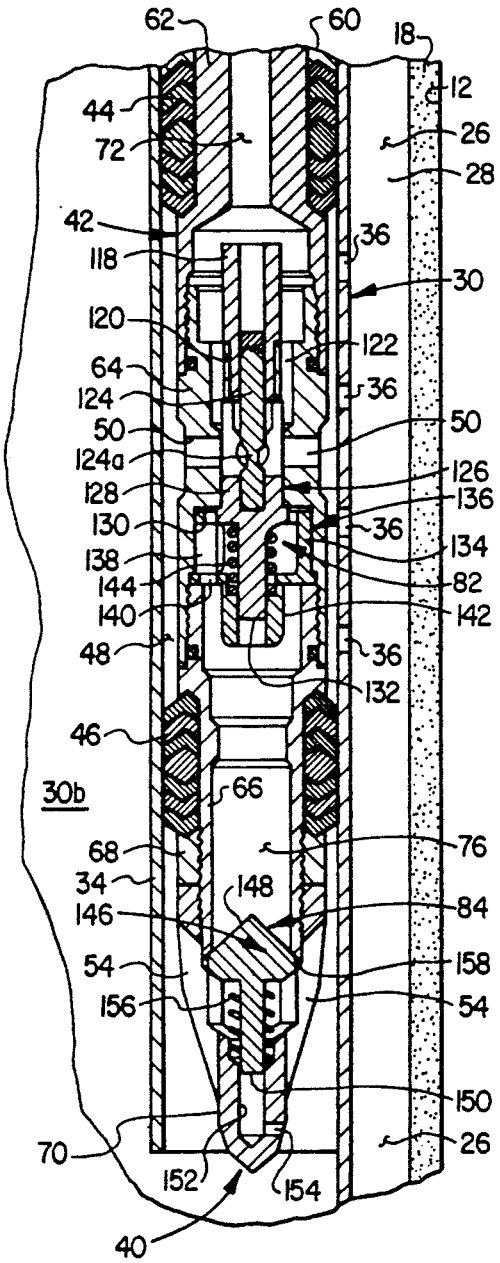

With reference now to FIGS. 3A and 3B, from top to bottom the hollow cylindrical body 42 of the valve 40 includes the following hollow, generally cylindrical metal sections having formed thereon the various illustrated reduced diameter portions and annular ledges: the latch member 52; a latch adapter 56; a back check seat 58; an adjustment and spring housing 60; a seat adapter 62; an inlet thimble 64 in which the valve body inlet ports 50 are formed; a lower packing adapter 66; a packing lock nut 68; and a discharge nose piece 70 at the lower end of the valve body 42, the valve body discharge slots 54 being formed in the nose piece 70.

At the upper end of the valve body 42 (FIG. 3A) the reduced diameter upper end of the latch adapter 56 is threaded into a corresponding opening in the lower end of the latch member 52, and the reduced diameter lower end of the latch adapter 56 is threaded into the upper end of the back check seat 58. The reduced diameter lower end of the back check seat 58 is threaded into the upper end of the adjustment/spring housing 60, and the lower end of the adjustment/spring housing 60 is threaded onto the upper end of the seat adapter 62 (see FIG. 3B), with facing annular ledge portions on the housing 60 and adapter 62 captively retaining the upper packer 44 externally on the valve body.

The lower end of the seat adapter 62 is threaded onto the upper end of the inlet thimble 64, and the lower end of the inlet thimble 64 is threaded onto the upper end of lower packing adapter 66. The lower end of the packing adapter 66 is threaded into the upper end of the discharge nose piece 70. The packing lock nut 68 is threaded onto a lower end portion of the packing adapter 66, above the nose piece 70. When components 68 and 70 are tightened against one another, they cooperate to externally and captively retain the lower packer 46 on the valve body.

It can be seen that the valve body inlet ports 50 are axially intermediate the upper end of the valve body 42 defined by the latch member 52 and the lower end of the valve body defined by the nose piece 70. The hollow interior of the body 42 defines a first internal flow passage 72 that extends axially upwardly from the inlet ports 50 and opens outwardly through a side wall outlet opening 74 (FIG. 3A) formed in the latch member 52. As illustrated, a reduced diameter upper end portion **72*a* of the internal flow passage 72 extends through the latch member 52 to the outlet opening 74**.

The hollow interior of the valve body 42 also defines a second internal flow passage 76 (see FIG. 3B) that extends axially downwardly from the inlet ports 50 and opens outwardly through the nose piece discharge slots 54. With respect to the inlet ports 50, the second internal flow passage 76 is in parallel with the first internal flow passage 72. For purposes later described, the maximum fluid flow capacity of the first internal flow passage 72 is substantially less than the maximum fluid flow capacity of the second internal flow passage 76.

First normally closed fluid flow control means, in the form of a spring loaded main relief valve structure 78 (FIG. 3A), and a spring loaded back check valve structure 80 positioned between the main relief valve structure 78 and the valve body outlet opening 74, are interposed in the first internal flow passage 72. In a manner subsequently described, these first flow control means are openable, to permit casing annulus fluid 28 to flow outwardly through the first internal flow passage 72 and the outlet opening 74 into the production tubing string 22, in response to a rise in the casing annulus/tubing string fluid pressure differential to a first set point magnitude (representatively about 3000 psig). The first fluid flow control means are then closable, to preclude casing annulus fluid outflow through the first interior flow passage 72 and the outlet opening 74 into the production tubing string 22, in response to a subsequent fall in the magnitude of the casing annulus/tubing string fluid pressure differential to below the first set point magnitude thereof, thereby resealing the casing annulus 26.

Second normally closed flow control means, in the form of a spring loaded, drawbar-supported plug valve structure 82 (FIG. 3B), and a spring loaded back check valve structure 84 positioned between the valve structure 82 and the nose piece discharge slots 54, are interposed in the second internal flow passage 76. In a manner subsequently described, the second flow control means are openable, to permit casing annulus fluid 28 to flow outwardly through the second internal flow passage 76 and the discharge or outlet slots 54 into the production tubing string 22, in response to a rise in the casing annulus/tubing string fluid pressure differential to a second set point magnitude (representatively about 4000 psig) substantially greater than the first set point magnitude.

Turning now to FIG. 3A, the main relief valve structure 78 includes an annular valve seat 83 captively retained in the upper end of the seat adapter 62; an annular guide member 86 captively retained within the adjustment/spring housing 60 directly above the valve seat 83 and having a circumferentially spaced series of axially extending flow grooves 88 formed in its interior side surface; a cylindrical valve body 90 slidably received in the guide member 86 and having a reduced diameter, upwardly projecting stem portion 92; a carbide seating ball 94 interposed between the valve body 90 and the valve seat 83; and a coiled compression spring 96 circumscribing the valve stem 92 and bearing at its lower end on the top side of the valve body 90.

The upper end of the spring 96 bears against the annular lower end portion of a adjustment member having a cylindrical body portion 98. Body portion 98 is threaded into a reduced diameter central cylindrical bore portion of the adjustment/spring housing 60 outwardly circumscribed by a circumferentially spaced series of axially extending fluid flow passages 100. The top end of the body portion 98 has a screwdriver slot 101 formed therein and upwardly faces the bottom end of a cylindrical locking member 104 also threaded into the reduced diameter central bore of the housing 60 and having a hex head slot 106 formed in its upper end. A rotatable ball member 10 is interposed between and contacted by the body 98 and the locking member 104.

Prior to the installation of the locking member 104 and the ball 108, the adjustment member body 98 may be threadingly advanced upwardly or downwardly as needed to selectively vary the downward resilient seating force exerted on the valve body 90 by the spring 96.

After this adjustment is made, the ball 108 and the locking member 104 are installed as shown and the member 104 is threadingly advanced downwardly to exert an axial locking force, via the ball 108, on the adjustment member body 98. The ball 108 serves to essentially prevent rotation of the locking member 104 from creating corresponding rotation of the adjustment member body 98 which would undesirably change the previously adjusted force setting of the spring 96.

The back check valve structure 80 includes a valve member having a tapered, cylindrically cross-sectioned body portion 110 and an annular, upwardly and outwardly tapered seating surface 112 formed within the interior of the back check seat 58. The valve body 110 is resiliently biased downwardly into sealing engagement with the valve seating surface 112 by a coiled compression spring 114 bearing at its upper end on an annular interior ledge portion 116 of the latch adapter.

Referring now to FIG. 3B, the plug valve structure 82 includes a tubular retention member 118 having a reduced diameter lower end portion threaded into a circular bore 120 disposed within the inlet thimble 64 above the valve body inlet ports 50. Bore 120 is outwardly circumscribed by a spaced series of vertically extending flow ports 122 formed in the thimble 64. An upper end portion of a cylindrical metal draw bar 124, having a reduced diameter neck portion **124*a*, is threaded into the reduced diameter lower end of the retention member 118**.

A plug valve member 126 has a cylindrical upper end portion 128 slidingly and sealingly received in the thimble 64, just below the inlet ports 50, and the lower end of the draw bar 124 is threaded downwardly into the valve member end portion 128. Accordingly, the draw bar 124 holds the plug valve member 126 in a position in which it seals off the second internal flow passage 76 below the valve body inlet ports 50.

Plug valve member 126 has an annular flange 130 on its bottom side, and a reduced diameter stem portion 132 extending downwardly from the flange 130. Flange 130 is slidably received in the hollow cylindrical body portion 134 of a retaining cage member 136. Body 134 is captively retained in the inlet thimble 64 and has an open top end, three axially extending transfer ports 138 only one of which is visible) formed in a side wall portion thereof, a bottom wall having a circumferentially spaced series of outlet ports 140 therein, and a hollow, downwardly extending cylindrical neck portion 142 that downwardly and slidingly receives the stem 132. A cylindrical compression spring 144 circumscribes the stem 132 and bears at its opposite ends on the underside of the flange 130 and an annular ledge formed in the bottom wall of the valve member body 134.

The back check valve structure 84 (FIG. 3B) includes a check valve member 146 having a tapered body portion 148 having a downwardly extending, reduced diameter stem portion 150. Stem portion 150 is slidingly received in a bore 152 formed in a lower end of the nose piece 70 and opening outwardly through the side wall of the nose piece via a relief port 154. A cylindrical compression spring 156 circumscribes the stem 150 and biases the valve body 148 upwardly into sealing engagement with an annular seating surface 158 formed on the lower end of the lower packing adapter 66.

The spring 96 (FIG. 3A) which downwardly biases the valve body 90 to its normally closed position within the first internal flow passage 72 is adjusted to permit upwardly directed fluid pressure force on the ball 94 to open the valve structure 78, and thus also open the back check valve check valve structure 80, when the casing annulus/tubing string fluid pressure differential reaches the representative first set point magnitude of 3000 psig. The draw bar 124 is configured to break at its neck portion **124*a* when the casing annulus/tubing string fluid pressure differential reaches the representative second set point magnitude of 4000 psig, the breakage of the draw bar permitting the downward fluid pressure differential across the valve structures 82 and 84** to downwardly open them.

During an initial production period of the well, the heat-created pressure rise in the brine solution 28 within the casing annulus 26 elevates the casing annulus/tubing string fluid pressure differential to reach its first set point magnitude, thereby opening the valve structures 78 and 80 while the draw bar 124 continues to hold the valve structure 82 closed. The opening of valve structures 78 and 80 allows elevated pressure annulus fluid to flow into the mandrel pocket **30*b* until the casing annulus/tubing string fluid pressure differential again falls to below the first set point magnitude, at which point the valve structures 78 and 80** close to reseal the casing annulus.

During a subsequent kill operation, as pressurized kill fluid is pumped downwardly into the casing annulus 26 the casing annulus/tubing string fluid pressure differential rises to the first set point magnitude thereof, thereby again opening the valve structures 78 and 80. However, since the flow capacity through the first internal passage 72 is considerably less than the kill fluid pumping rate, the casing annulus/tubing string fluid pressure differential continues to rise until its second set point magnitude is reached, at which point the draw bar 124 is broken to permit the fluid pressure differential opening of the valve structures 82 and 84 and the rapid flow of annulus fluid into the production tubing string 22 through the now opened second internal flow passage 76. At this moment, the valve structure 80 typically closes because the casing annulus/tubing string fluid pressure differential abruptly declines (to about 1500 psig at kill fluid pumping rates of about four to five barrels per minute).

When the kill fluid pumping is terminated, the spring 156 returns valve structure 84 to its normally closed position. After the kill operation is completed, the valve 40 may be upwardly retrieved through the tubing string, to replace the broken draw bar 124, and then reinstalled in the mandrel 30.

The foregoing detailed description is to be clearly understood as being given by way of illustration and example only, the spirit and scope of the present invention being limited solely by the appended claims.

What is claimed is:

1. A combination pressure relief/kill valve operatively supportable within a ported valve receptacle installed in a well production tubing string surrounded by a fluid-filled casing annulus, said valve comprising:

a hollow body having inlet opening means for admitting pressurized casing annulus fluid into the interior of said body, a first outlet opening, a second outlet opening, a first internal flow passage extending from said inlet opening means to said first outlet opening, and a second internal flow passage extending from said inlet opening means to said second outlet opening in parallel with said first internal flow passage and having a fluid flow rate capacity substantially higher than that of said first internal flow passage, said hollow body being supportable within the ported valve receptacle in a manner communicating said inlet opening means with the casing annulus and communicating said first and second outlet openings with the interior of the receptacle, and thus with the interior of the tubing string;

sealing means externally carried on said hollow body and operative, when said hollow body is supported within the ported valve receptacle, to sealingly isolate said inlet opening means from said first and second outlet openings, whereby said inlet opening means are exposed to the fluid pressure within the casing annulus, and said first and second outlet openings are exposed to the fluid pressure within the tubing string;

first normally closed flow control means interposed in said first internal flow passage and being openable, when said hollow body is operatively supported within the ported valve receptacle, to permit fluid outflow through said first internal flow passage and said first outlet opening into the ported valve receptacle in response to a rise in the casing annulus/tubing string fluid pressure differential to a first set point magnitude, and reclosable, to preclude fluid outflow through said first internal flow passage and said first outlet opening into the ported valve receptacle, in response to a subsequent fall in the magnitude of the casing annulus/tubing string fluid pressure differential to below said first set point magnitude thereof; and second normally closed flow control means interposed in said second internal flow passage and being openable, when said hollow body is supported within the ported valve receptacle, to permit fluid outflow through said second internal flow passage and said second outlet opening into the ported valve receptacle in response to a rise in the casing annulus/tubing string fluid pressure differential to a second set point magnitude substantially greater than said first set point magnitude thereof.

2. The valve of claim 1 wherein:

said hollow valve body has an elongated, generally cylindrical configuration, said inlet opening is positioned on a longitudinally intermediate portion of said body, said first outlet opening is disposed on a first end portion of said valve body, said first internal flow passage extends generally axially through said body from said inlet opening to said first outlet opening, said second outlet opening is disposed on a second end portion of said body, and said second internal flow passage extends generally axially through said body from said inlet opening to said second outlet opening.

3. The valve of claim 2 wherein said sealing means include:

first and second annular packer structures coaxially and externally carried on said body and respectively positioned above and below said inlet opening.

4. The valve of claim 2 wherein:

said first end portion of said body is defined by a generally cylindrical latch member, said first outlet opening is disposed on a side portion of said latch member, and said first internal flow passage extends generally axially through said latch member and then turns radially outwardly to said first outlet opening.

5. The valve of claim 4 wherein:

the portion of said first internal flow passage disposed within said latch member has a generally smaller cross-section than the balance of said first internal flow passage.

6. The valve of claim 1 wherein said first flow control means include:

a spring loaded main relief valve structure operatively disposed in said first internal flow passage between said inlet opening and said first outlet opening.

7. The valve of claim 6 wherein said first flow control means further include:

a spring loaded back check valve structure operatively disposed in said first internal flow passage between said main relief valve structure and said first outlet opening.

8. The valve of claim 6 further comprising:

means for selectively adjusting the spring force of said spring loaded main relief valve.

9. The valve of claim 1 wherein said second flow control means include:

a spring loaded main plug valve member releasably held in a closed position within said second internal flow passage by a frangible draw bar member configured to be broken in response to the creation of a predetermined fluid pressure differential across said main plug valve member.

10. The valve of claim 9 wherein said second flow control means further include:

a spring loaded back check valve operatively positioned in said second internal flow passage between said main plug valve and said second outlet opening.

11. A subterranean well system comprising:

a bore hole extending downwardly into the earth to a subsurface production zone containing a retrievable well fluid, said bore hole being internally lined with a generally tubular casing structure having side wall perforations therein positioned at the production to admit well fluid therefrom into said casing structure;

a production tubing string extending downwardly through said casing structure and defining therewith a casing annulus circumscribing said production tubing string:

a packer structure sealingly disposed within said casing structure above said casing perforations and connected to said production tubing string, said packer structure sealing off a lower interior casing structure portion below said packer structure from said casing annulus, said lower interior casing structure portion communicating with the interior of said production tubing string;

a fluid disposed within said casing annulus and hydraulically supporting said casing structure;

a hollow valve receptacle installed in said production tubing string and having an inlet opening; and a combination casing pressure relief and kill valve disposed in said valve receptacle and including:

a hollow body having an inlet opening communicating with said valve receptacle inlet opening, first and second outlet openings communicating with the interior of said valve receptacle, and thus with the interior of said production tubing string, a first internal flow passage extending from said valve body inlet opening to said first outlet opening, a second internal flow passage extending from said valve body inlet opening to said second outlet opening in parallel with said first internal flow passage and having a fluid flow rate capacity substantially higher than that of said first internal flow passage, and sealing means externally carried on said valve body, engaging said valve receptacle, and sealingly isolating said valve body inlet opening from said first and second outlet openings, first normally closed flow control means interposed in said first internal flow passage and being openable, to permit casing annulus fluid outflow through said first internal flow passage and said first outlet opening into said valve receptacle, in response to a rise in the casing annulus/tubing string fluid pressure differential of a first set point magnitude, and reclosable, to preclude casing annulus fluid outflow through said first internal flow passage and said first outlet opening into said valve receptacle, in response to a subsequent fall in the magnitude of the casing annulus/tubing string fluid pressure differential to below said first set point magnitude thereof, and second normally closed flow control means interposed in said second internal flow passage and being openable, to permit casing annulus fluid outflow through said second internal flow passage and said second outlet opening into said valve receptacle in response to a rise in the casing annulus/tubing string fluid pressure differential to a second set point magnitude substantially greater than said first set point magnitude thereof.

12. The valve of claim 11 wherein:

said hollow valve body has an elongated, generally cylindrical configuration, said inlet opening is positioned on a longitudinally intermediate portion of said body, said first outlet opening is disposed on a first end portion of said valve body, said first internal flow passage extends generally axially through said body from said inlet opening to said first outlet opening, said second outlet opening is disposed on a second end portion of said body, and said second internal flow passage extends generally axially through said body from said inlet opening to said second outlet opening.

13. The valve of claim 12 wherein said sealing means include:

first and second annular packer structures coaxially and externally carried on said body and respectively positioned above and below said inlet opening.

14. The valve of claim 12 wherein:

said first end portion of said body is defined by a generally cylindrical latch member, said first outlet opening is disposed on a side portion of said latch member, and said first internal flow passage extends generally axially through said latch member and then turns radially outwardly to said first outlet opening.

15. The valve of claim 14 wherein:

the portion of said first internal flow passage disposed within said latch member has a generally smaller cross-section than the balance of said first internal flow passage.

16. The valve of claim 11 wherein said first flow control means include:

a spring loaded main relief valve structure operatively disposed in said first internal flow passage between said inlet opening and said first outlet opening.

17. The valve of claim 16 wherein said first flow control means further include:

a spring loaded back check valve structure operatively disposed in said first internal flow passage between said main check valve structure and said first outlet opening.

18. The valve of claim 16 further comprising:

means for selectively adjusting the spring force of said spring loaded main relief valve.

19. The valve of claim 11 wherein said second flow control means include:

a spring loaded main plug valve member releasably held in a closed position within said second internal flow passage by a frangible draw bar member configured to be broken in response to the creation of a predetermined fluid pressure differential across said main plug valve member.

20. The valve of claim 19 wherein said second flow control means further include:

a spring loaded back check valve operatively positioned in said second internal flow passage between said main plug valve and said second outlet opening.

21. For use in a subterranean well of the type having a bore hole extending downwardly into the earth, a tubing string extending downwardly through the bore hole and operative to flow a production fluid upwardly to the surface, a casing structure lining said bore hole, and a sealed, fluid-filled annulus circumscribing the tubing string and radially outwardly bounded by the casing structure, a method of relieving a heat-generated fluid pressure increase within the casing annulus during an initial production period of the well, and subsequently killing the well, said method comprising the steps of:

providing a single valve having a hollow body having an inlet opening, first and second outlet openings, a first internal flow passage extending from said inlet opening to said first outlet opening, and a second internal flow passage extending from said inlet opening to said first outlet opening, and a second internal flow passage extending from said inlet opening to said second outlet opening in parallel with said first internal flow passage and having a fluid flow rate capacity substantially higher than that of said first internal flow passage;

communicating said valve body inlet opening with the casing annulus;

communicating said first and second valve body outlet openings with the interior of said production tubing string;

using said valve to relieve a heat-generated fluid pressure increase within the casing annulus, during an initial production period of the well, by causing a portion of the elevated pressure annulus fluid to flow into the interior of said tubing string, through said first internal valve body flow passage, when the operating casing annulus/tubing string fluid pressure differential reaches a first predetermined magnitude; and killing the well, during a subsequent production period thereof, by forcing a pressurized kill fluid into the casing annulus, at a flow rate substantially higher than the flow rate capacity of said first internal valve body flow passage, in a manner elevating the magnitude of the casing annulus/tubing string fluid pressure differential to a second predetermined magnitude greater than said first predetermined magnitude, and then causing pressurized fluid to flow into the interior of the tubing string from the casing annulus through said second internal valve body flow passage while continuing to force pressurized kill fluid into the casing annulus.

22. For use in a subterranean well of the type having a bore hole extending downwardly into the earth, a tubing string extending downwardly through the bore hole and operative to flow a production fluid upwardly to the surface, a casing structure lining said bore hole, and a sealed, fluid-filled annulus circumscribing the tubing string and radially outwardly bounded by the casing structure, a method of relieving a heat-generated fluid pressure increase within the casing annulus during an initial production period of the well, and subsequently killing the well, said method comprising the steps of:

installing a valve receptacle in the tubing string during the initial construction of the well, the installed receptacle having an interior communicating with the interior of the tubing string, and an inlet opening through which casing annulus fluid may enter the receptacle;

providing a valve having:

a hollow body having inlet opening means for admitting pressurized casing annulus fluid into the interior of said body, a first outlet opening, a second outlet opening, a first internal flow passage extending from said inlet opening means to said first outlet opening, and a second internal flow passage extending from said inlet opening means to said second outlet opening in parallel with said first internal flow passage and having a fluid flow rate capacity substantially higher than that of said first internal flow passage, first normally closed flow control means interposed in said first internal flow passage and being openable, to permit fluid outflow through said first internal flow passage and said first outlet opening, in response to a rise in the fluid pressure differential across said first flow control means, from their inlet side to their outlet side, to a first set point magnitude, and reclosable, to preclude fluid outflow through said first internal flow passage and said first outlet opening, in response to a subsequent reduction in the fluid pressure differential across said first flow control means to a magnitude below said first set point magnitude, second normally closed flow control means interposed in said second internal flow passage and being openable, to permit fluid outflow through said second internal flow passage and said second outlet opening, in response to a rise in the fluid pressure differential across said second flow control means, from their inlet side to their outlet side, to a second set point magnitude substantially higher than said first set point magnitude, and spaced apart first and second seal means extending externally around said valve body, said inlet opening means being interposed between said first and second seal means;

installing said valve within the interior of said valve receptacle in a manner communicating said valve body inlet opening means with the casing annulus through said valve receptacle inlet opening, communicating said first and second valve body outlet openings with the interior of said valve receptacle, and causing said first and second seal means to sealingly isolate said valve body inlet opening means from said first and second valve body outlet openings;

using the installed valve to relieve a heat-created fluid pressure increase within the casing annulus, during an initial production period of the well, by permitting a portion of the elevated pressure annulus fluid to flow into the interior of said valve receptacle, through said first internal valve body flow passage, when the operating casing annulus/tubing string fluid pressure differential reaches said first set point magnitude; and killing the well, during a subsequent production period thereof, by:

forcing a pressurized kill fluid into the casing annulus, at a flow rate substantially higher than the flow rate capacity of said first internal valve body flow passage, in a manner elevating the magnitude of the casing annulus/tubing string fluid pressure differential to said second set point magnitude, to thereby cause said second flow control means to open, and permitting pressurized fluid to flow into said valve receptacle, and thus into the tubing string, from the casing annulus through the opened second internal valve body flow passage while continuing to force pressurized kill fluid into the casing annulus.

* * * * *